United States Patent [19]

Monroe

[11] Patent Number: 4,992,626

[45] Date of Patent: Feb. 12, 1991

[54] ELECTRICAL CABLE FOR VEHICLES

[75] Inventor: John W. Monroe, Warren, Mich.

[73] Assignee: The United States of America as represented by the Secretary of the Army, Washington, D.C.

[21] Appl. No.: 420,801

[22] Filed: Oct. 12, 1989

[51] Int. Cl.[5] ..... H01B 7/34

[52] U.S. Cl. ..... 174/36; 156/51; 174/35 SM; 174/68.3; 174/95

[58] Field of Search ..... 174/35 SM, 36, 68, 3, 174/95; 156/48, 50, 51; 29/867

[56] References Cited

U.S. PATENT DOCUMENTS

| | | | |
|---|---|---|---|
| 3,132,415 | 5/1964 | Johnson et al. | 174/68.3 X |
| 3,892,912 | 7/1975 | Hauck | 174/68.3 |
| 4,018,715 | 4/1977 | Tatum | 174/6 X |
| 4,582,093 | 4/1986 | Hubbard et al. | 174/95 X |
| 4,599,483 | 7/1986 | Kuhn et al. | 174/36 |
| 4,678,865 | 7/1987 | Sherwin | 174/36 |
| 4,688,890 | 8/1987 | DeMeo et al. | 174/68.3 X |
| 4,755,629 | 7/1988 | Beggs et al. | 174/36 X |
| 4,786,757 | 1/1988 | Owensby et al. | 174/68.3 X |

FOREIGN PATENT DOCUMENTS

| | | | |
|---|---|---|---|
| 3734248 | 4/1989 | Fed. Rep. of Germany | 174/68.3 |

*Primary Examiner*—Morris H. Nimmo

*Attorney, Agent, or Firm*—Peter A. Taucher; David L. Kuhn

[57] ABSTRACT

Disclosed is an improved cable for connecting electrical components inside a combat vehicle, the cable being comprised of a plurality of tubes surrounding individual wire bundles inside the cable. The tubes are resistant to diametrical crushing and have low-friction outer diametrical surfaces to facilitate relative axial sliding between the tubes. When the combat vehicle is being electrical repaired or updated, damaged or obsolete wire bundles can be slid out of the tubes and new wire bundles can thereafter be slid into the vacant tube.

17 Claims, 3 Drawing Sheets

ELECTRICAL CABLE FOR VEHICLES

GOVERNMENT INTEREST

The invention herein may be manufactured, used and licensed by or for the U.G. Government for governmental purposes without payment to me of any royalty thereon.

BACKGROUND

The invention herein relates to electrical cables and wire harnesses in vehicles and more particularly relates to cables in combat vehicles such as tanks.

Typical electrical cables in tanks have a single bundle of insulated wires surrounded by a metal braided or meshed sleeve. This sleeve shunts electro-magnetic energy away from the wire bundle when the bundle carries electrical current. The mesh sleeve thereby reduces the electromagnetic signature of the tank and prevents false electrical signals from being generated within the cable. Surrounding the mesh is a hose-like elastomeric skin for protecting the wire bundle from substances such as fuel, oil, dirt, or chemicals used to decontaminate the tank after it is chemically or biologically attacked. The skin is made of material that will shrink upon heating, and during fabrication of the cable the wire bundle and meshed sleeve are inserted loosely into an oversized skin and this skin is heated. The skin shrinks conformingly onto the bundle/sleeve subassembly.

Electrical cables in tanks are generally difficult to access since they are routed behind interior components of the tank such as bulkheads, control panels, ammunition racks and the like. In addition, the drive train, fuel system, exhaust system and other subassemblies often partially block access to a given cable. Consequently, replacement of a wire in the wire bundle requires not only removal and replacement of the cable, but also requires a substantial amount of time and labor to remove and replace components near the cable. The extensive repair time needed to replace cables is costly and can critically reduce the tank's availability in a battle or wartime scenario. Also, modernization or upgrading the electrical system of a tank can be difficult if cables with different wiring are needed.

SUMMARY OF THE INVENTION

My invention is a cable having individual plastic tubes inside a covering of metal braid and elastomeric skin. The tubes run the length of the cable and accommodate individual bundles of wire. The interior surface of the tubes has a low coefficient of friction so as to facilitate threading of the individual wire bundles through the tubes. Consequently, if a given set of wires are to be changed, individual wire bundles can be replaced rather than the entire cable. The tubes are constructed to resist diametrical compression and permit axial bending, thereby protecting the wire bundles while allowing the cable to b bent for ease of routing it through the tank. The tubes may be axially slidable relative to one another so as to minimize tension or compression on the tubes and wire bundles when the cable is bent.

DETAILED DESCRIPTION

Figure 1:
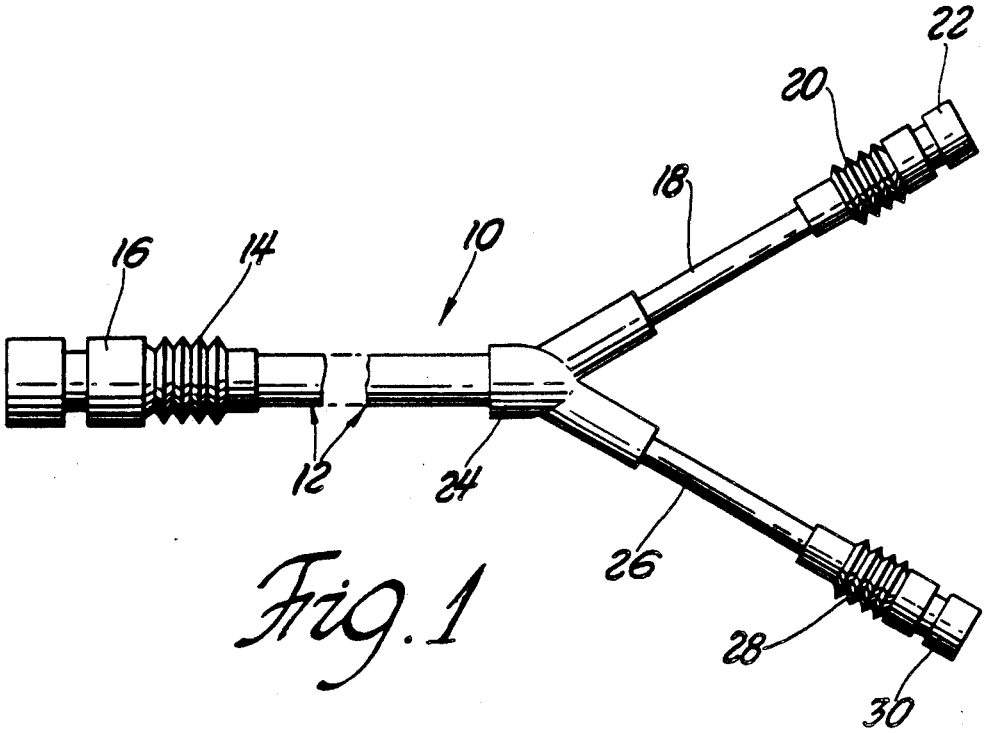
FIG. 1 is a cable with a Y connection
Figure 2:
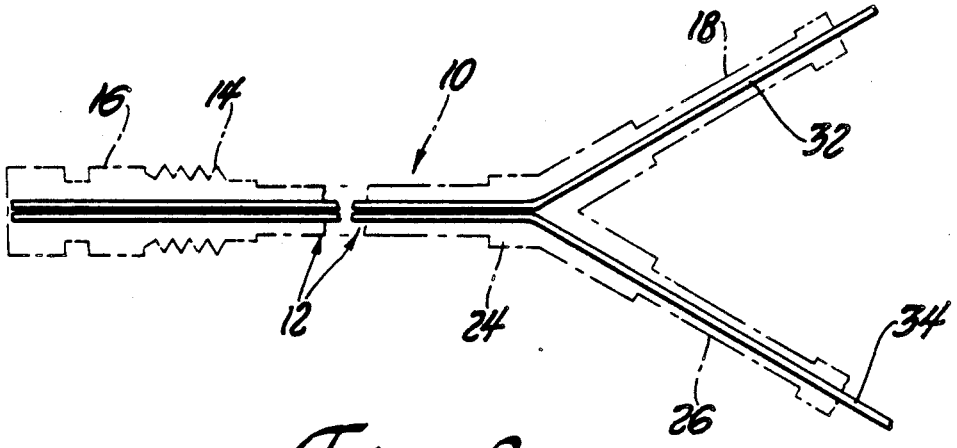
FIG. 2 shows tubes arranged to to fit inside the Y connection of FIG. 1.

In FIG. 1 is shown a cable 10 having a main cable body 12 attached to branch cable bodies 18 and 26 by means of a Y transition 24. At the free ends of the respective cable bodies re flexible elastomeric boots 14, 20 and 28 joined to respective connectors 16, 22 and 30. The connectors have pins or sockets (not shown) electrically connected to wires within the cable such as those in wire bundles 36 and 38 in FIG. 3. FIG. 2 shows tubes 32 and 34 which run inside of cable 10, tube 32 being partly within branch cable body 18 and tube 34 being partly in branch cable body 26. Only two tubes are shown, but a multiplicity of tubes such as tube 32 can be fit into bodies 12 and 18, and a multiplicity of tubes such as tube 34 could be fit inside of bodies 12 and 26. Tubes 32 and 34 are preferably made of a plastic such as nylon and have low-friction inner diametrical surfaces to slidingly accommodate wire bundles running through the tubes. The outer diametrical surfaces of tubes 32 and 34 can also be made of low friction material so as to facilitate axial sliding movement of one tube relative to another. The tubes are constructed so as to be easily bent along their longitudinal axes while being resistant to diametrical squeezing or crushing. The resistance of the tubes to diametrical compression protects wire bundles within the tubes once the cable is in the vehicle.

Figure 3:
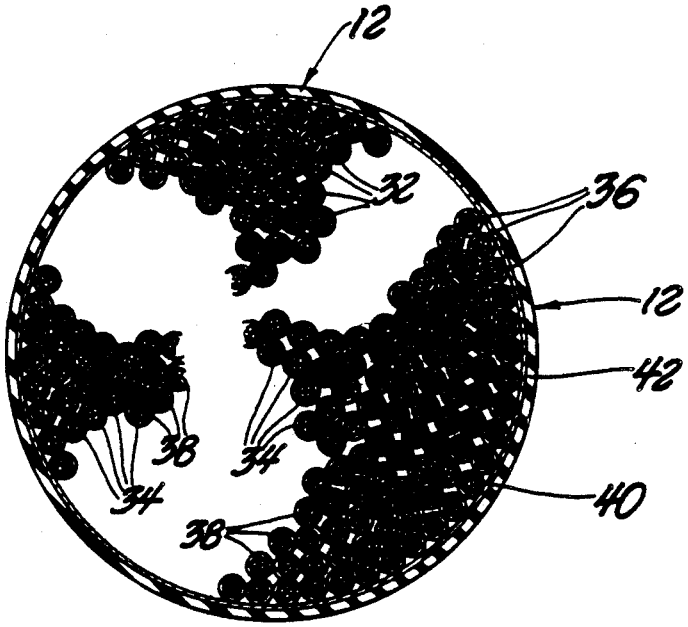
FIG. 3 is a cross section of my cable showing tubes and the wire bundles therein.
Figure 4:
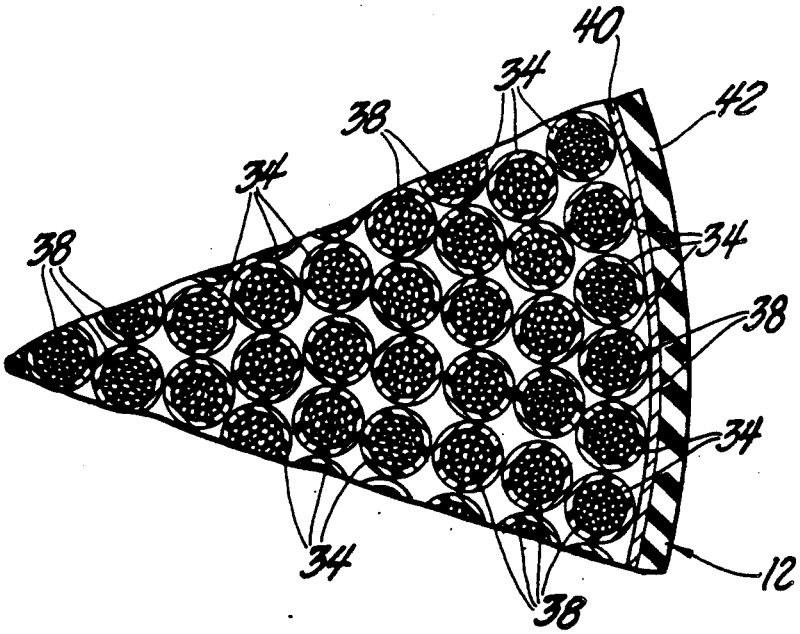
FIG. 4 is an enlarged sector of a cross section of my cable.

FIG. 3 shows a cross section of main cable body 12 and shows cross sections of tubes 32 and 34 within the main cable body. FIG. 4 is an enlarged view of a sector of a cross section of main cable body 12. Groups of insulated wires running through main cable body 12 are gathered in bundles 36 or 38 within tubes 32 and 34 respectively. The tubes 32 and 34 are in a closely packed array within main cable body 12. The tubes are held together by a generally cylindrical sleeve 40 formed of a electromagnetic, flexible material such as braided or meshed shield. Surrounding sleeve 40 is a skin 42 which covers main cable body 12 and which also covers branch cable bodies 18 and 26. Shielding mesh sleeves 40 and skins such as at 42 are already known. Skin 42 is preferably formed of a heat shrinkable rubber that is first fit loosely over the exterior of main cable body 12 and heated. Skin 42 then shrinks tightly against the exterior of steel mesh sleeve 40 so that the overall cross-sectional area of main cable body 12 is minimized.

Figure 5:
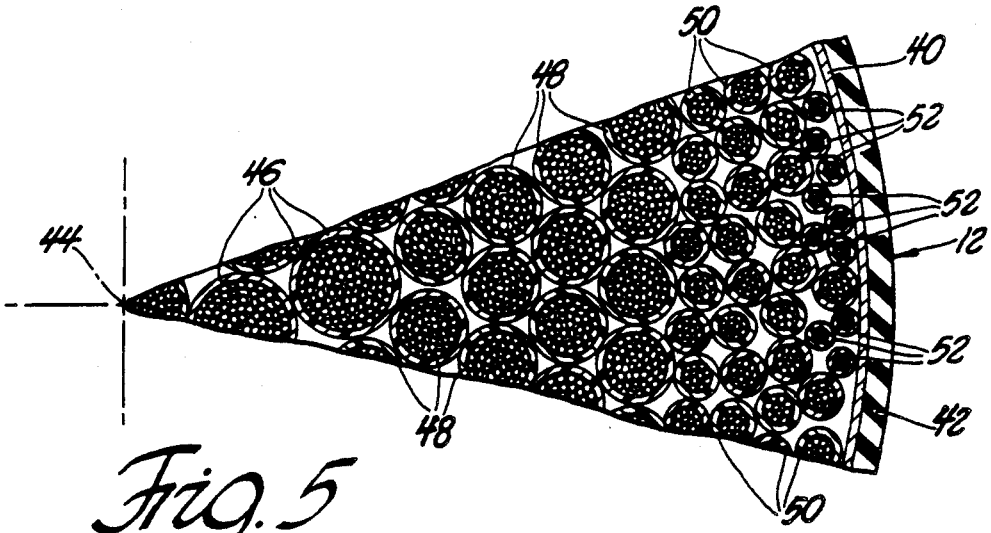
FIG. 5 is a sector of a cross section of a first alternate embodiment of my cable.

FIG. 5 is an alternate embodiment of the main cable body 12 shown in FIG. 4. The FIG. 5 embodiment has four sizes of tubes, the largest diameter tube 46 being the closest to central axis 44 of main cable body 12 and also being and the furthest from sleeve 40. The second largest tubes are inner intermediate tubes 48, which are in a zone immediately radially outside the zone occupied by tubes 46. The next largest tubes are outer intermediate tubes 50, which are immediately radially outward of tubes 48. Smallest diameter tubes 52 can occupy most or all of the zone immediately radially inward of sleeve 40, tubes 52 generally being radially outward of tubes 50. All of the tubes in FIG. 5 will have the capacity to accommodate wire bundles, although it is possible for some of the tubes to be empty. The number of tube sizes could be greater or fewer than four, depending on the specific requirement of a given cable application.

It is contemplated that the terminals of cable 10 (as at 16, 22 and 30 in FIG. 1) need not necessarily be fastened to the ends of the cable until the cable is bent into the configuration it will have in the tank or other vehicle when it is installed. The terminals could be placed on the cable after the cable is installed in the vehicle or, alternatively, the cable could be bent and terminals put on before the cable is installed in the vehicle. In either event, the tubes in the cable could axially slide against one another when the cable bends and thereby eliminate some of the compression and tension the cable would otherwise experience upon bending.

During bending of cable 10, tubes on the inside of the bend tend to undergo the most stress and strain, and larger tubes undergo greater compression and tension because of their greater diametrical thickness. To avoid subjecting the larger tubes to maximum possible compression and tension, the larger tubes are placed nearer to the center of the cable in the FIG. 5 embodiment. This will make the cable more flexible and protect the larger tubes (46, 48 in FIG. 5) from being damaged by bending.

Figure 6:
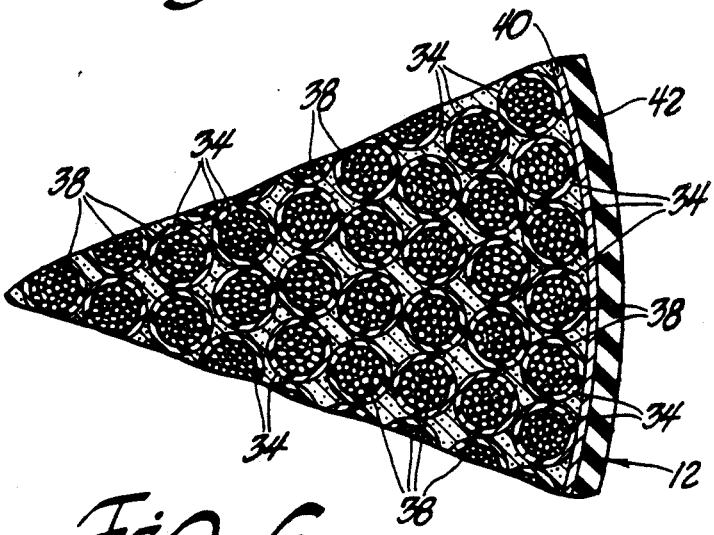
FIG. 6 is a sector of a cross section of a second alternate embodiment of my cable.

FIG. 6 is a second alternate embodiment of the main cable body 12 shown in FIG. 3. The FIG. 6 embodiment is different from FIG. 4 in that a compressed graphite matrix fills the interstices between the tubes. The graphite matrix will serve two purposes, the first purpose being to facilitate relative sliding movement between adjacent tubes. The second purpose is to provide a shunt for undesired electromagnetic energy generated when electrical signals or electrical power pass through the wire bundles. The graphite will be sufficiently compressed so that contact between the graphite particles will suffice to provide a path for electromagnetic flux from one end of the cable to the other. The graphite will thereby reduce electromagnetic interference between cable 10 and any other electrical components near the cable. In addition, the graphite will act to reduce the electromagnetic signature of the vehicle of which the cable is part. It is believed that the use of graphite in the interstitial spaces will permit the mesh sleeve 40 to be replaced by a cheaper sleeve or will permit sleeve 40 to be eliminated entirely. It may be preferable in some applications to have powdered ferrite mixed in with the graphite. The added ferrite will help suppress electromagnetic radiation into or from the wires in the cable.

Figure 7:
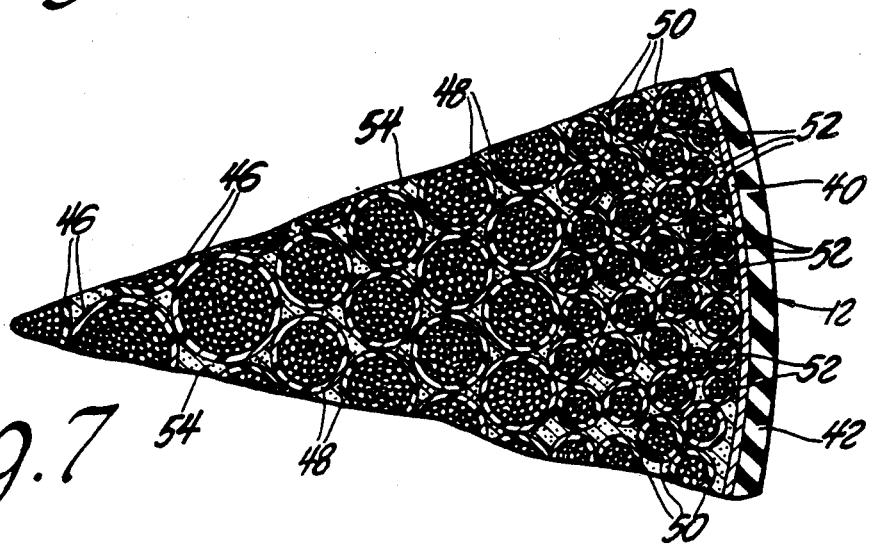
FIG. 7 is a sector of a cross section of a third embodiment of my cable.

FIG. 7 is the same as the FIG. 5 embodiment except that the FIG. 7 embodiment includes a compressed graphite matrix filling the interstitial spaced between the tubes 46, 48, 50 and 52.

I wish it to be understood that I do not desire to be limited to the exact details of construction shown and described herein since obvious modifications will occur to those skilled in the relevant art without departing from the spirit and scope of the following claims.

I claim:

1. A cable having replaceable wire bundles, comprising:

a generally cylindrical sleeve;

a plurality of tubes running along an inside the cylindrical sleeve;

the tubes being packed closely together inside the sleeve and having low-friction outer diametrical surfaces to facilitate relative axial sliding movement between any two adjoining tubes and to facilitate relative sliding movement between the cylindrical sleeve and radially outermost tubes bearing against the cylindrical sleeve;

bundles of insulated wires running through the tubes;

the tubes having smooth, low-friction inner diametrical surfaces to facilitate axial sliding movement between the bundles and the tubes.

2. The cable of claim 1 wherein the tubes are of varying diameters, the larges diameters being closest to a longitudinal axis of the cable and the tubes having smallest diameters being furthest from the longitudinal axis, and tubes having intermediate diameters being disposed radially between the largest diameter tubes and the smallest diameter tubes.

3. The cable of claim 2 wherein the tubes having smaller intermediate diameters are further from the longitudinal axis of the cable than are the tubes having larger intermediate diameters.

4. The cable of claim 1 wherein the cable defines elongate interstitial spaces along and outside the tubes, the spaces being filled with packed graphite particles.

5. The cable of claim 1 wherein the tubes are made of nylon plastic.

6. The cable of claim 1 wherein the cable defines elongate interstitial spaces along and outside the tubes, the spaces being filled with an electrically conductive lubricant material.

7. A method of making a cable for connecting electrical components in an assembly, comprising:

providing a plurality of round tubes having low-friction inner diametrical and outer diametrical surfaces, the tubes being elastically bendable along their longitudinal axes and being resistant to compression in a radial direction;

inserting the tubes into a cable sleeve;

inserting a bundle of wires into at least some of the tubes so that the wires extend from the ends of the tubes;

bending the sleeve into a final configuration, the final configuration being the same as the configuration of the sleeve when the sleeve is in the assembly;

fixing terminals to the wires, the terminals having leads electrically connected to the wires;

fixing the terminals to the sleeves and fixing the tubes relative to the terminals and the sleeves.

8. The method of claim 7 wherein bending of the sleeve into a final configuration occurs before the cable is being installed in the assembly.

9. The method of claim 7 wherein bending of the sleeve into a final configuration occurs as the cable is being installed in the assembly.

10. The method of claim 7 wherein less than all of the tubes have the bundled set of wires inserted therein, whereby a number of the tubes remain hollow.

11. The method of claim 7 further including a subsequent revision of the cable, the revision including the steps of:

disconnecting the terminals from the wires and removing the terminals from the free ends of the cable;

inserting a new bundled set of wires into one of the tubes.

12. The method of claim 11 including the step of first removing a pre-existing bundled set of wires from the one tube and inserting the new bundled set of wires into the one tube.

13. A cable having replaceable wire bundles, comprising:

a sleeve;

a plurality of tubes inside the sleeve, the tubes having low-friction outer diametrical surfaces;

bundles of wires running through at least some of the tubes;

wherein the tubes are of varying diameters, the tubes having the larger diameters being closer to the longitudinal axis of the cable than tubes having smaller diameters.

14. The cable of claim 13 wherein the tubes are flexible for bending along their longitudinal axes but are resistant to being diametrically compressed.

15. The cable of claim 13 wherein a flexible electromagnetically conductive mesh is exposed at the inner diametrical surface of the sleeve.

16. The cable of claim 13 wherein the cable defines elongate interstitial spaces along and outside the tubes, the spaces being filled with an electrically conductive lubricant material.

17. A cable having replaceable wire bundles, comprising:

a generally cylindrical sleeve;

a plurality of tubes running along and inside the cylindrical sleeve;

the tubes being packed closely together inside the sleeve and having low-friction outer diametrical surfaces to facilitate relative axial sliding movement between any two adjoining tubes and to facilitate relative sliding movement between the cylindrical sleeve and radially outermost tubes bearing against the cylindrical sleeve;

bundles of insulated wires running through the tubes;

the tubes having low-friction inner diametrical surface to facilitate axial sliding movement between the bundles and the tubes;

wherein the tubes are of varying diameters, the tube shaving the largest diameters being closest to the longitudinal axis of the cable and the tubes having the smallest diameters being furthest from the longitudinal axis, and tubes having intermediate diameters being disposed radially between the largest diameter tubes and the smallest diameter tubes.

* * * * *